US006699328B1

(12) United States Patent
Scholzig et al.

(10) Patent No.: US 6,699,328 B1
(45) Date of Patent: Mar. 2, 2004

(54) DEVICE FOR THE TEMPERATURE EQUALISATION OF COATING MEDIA

(75) Inventors: Jurgen Scholzig, Mainz-Finthen (DE); Ulrich Jung, Limburg (DE)

(73) Assignee: MAN Roland Druckmaschinen AG, Offenbach/Main (DE)

( * ) Notice: Subject to any disclaimer, the term of this patent is extended or adjusted under 35 U.S.C. 154(b) by 0 days.

(21) Appl. No.: 10/049,171

(22) PCT Filed: Jul. 13, 2000

(86) PCT No.: PCT/EP00/06675

§ 371 (c)(1),
(2), (4) Date: May 20, 2002

(87) PCT Pub. No.: WO01/10568

PCT Pub. Date: May 15, 2001

(30) Foreign Application Priority Data

Aug. 7, 1999 (DE) ..... 199 37 467

(51) Int. Cl.[7] ..... B05C 1/02

(52) U.S. Cl. ..... 118/641; 118/58; 118/60; 118/69; 118/202; 118/236; 118/262; 118/667; 101/487; 101/488

(58) Field of Search ..... 118/641, 58, 60, 118/69, 202, 236, 261, 262, 666, 667, 211; 101/487, 488

(56) References Cited

U.S. PATENT DOCUMENTS

| | | | | |
|---|---|---|---|---|
| 3,750,746 A | | 8/1973 | Norman | |
| 5,272,971 A | * | 12/1993 | Fredericks | 101/136 |
| 5,520,739 A | | 5/1996 | Frazzitta | |
| 5,605,575 A | | 2/1997 | Anderson | |
| 5,784,957 A | * | 7/1998 | Rau et al. | 101/142 |
| 5,882,469 A | | 3/1999 | Detterman et al. | |

FOREIGN PATENT DOCUMENTS

| | | | |
|---|---|---|---|
| EP | 0722832 A2 | * | 7/1996 |
| EP | 0 802 250 A2 | | 10/1997 |

* cited by examiner

*Primary Examiner*—Laura Edwards
(74) *Attorney, Agent, or Firm*—Leydig Voit & Mayer, Ltd.

(57) ABSTRACT

Temperature control of the coating medium is performed to influence the processability of coating media in an applicator system. In order to operate without losing efficiency, devices acting directly from the inside or the outside for heat supply or dissipation are connected to the elements guiding the coating medium. The temperature of the coating medium is influenced by measuring the temperature within the coating medium and, if necessary, at the elements guiding the coating medium.

13 Claims, 1 Drawing Sheet

DEVICE FOR THE TEMPERATURE EQUALISATION OF COATING MEDIA

FIELD OF THE INVENTION

The invention pertains to a device for temperature control of coating mediums used in printing machines.

BACKGROUND OF THE INVENTION

In applicator systems for printing presses, e.g., in coating systems, it is known to regulate the viscosity of the coating medium by means of temperature control. Temperature control can be used to regulate the processability of coating media for different types of media and for different methods of application. This can expand the processing range of such an applicator system.

A known device for coating surfaces in a printing process is disclosed in U.S. Pat. No. 5,520,739 A. This reference indicates that a coating composition for different systems can be supplied from a single storage container for the feeding of coating compositions to printing processes. Each device for supplying the coating composition is described as a reactor vessel, in which the temperature, and thus also the viscosity, of the coating composition can be influenced. For this purpose, there is a heat exchanger and a temperature sensor, as well as a viscometer for determining the viscosity of the coating composition in the reactor vessel.

The described device has the disadvantage that the coating composition can only be affected or controlled before the actual printing process or coating process. On the way between the reactor vessel and the printing process, however, the physical properties of the coating composition can change.

Another disadvantage of the above described device is that not all of the processing sequences can be affected by the processing sequences of temperature control. It is commonly necessary for there to be processing sequences for the rinsing or cleaning of the applicator system and the elements contained therein that transport the coating composition in order to prevent permanent contamination through hardening of the coating composition. Here, it is also advantageous to control the temperature of the cleaning process. This is not possible with the described device.

OBJECTS AND SUMMARY OF THE INVENTION

It is an object invention is to provide a coating system for a printing press in which the temperature of the coating medium is more reliably controlled in close proximity to the printing process and in which the cleaning process following a coating operation also may be temperature controlled for optimum processing.

In carrying out the invention, it is advantageous if the temperature control of the coating composition is not performed in a storage container, but instead directly at the place of processing. Suitable positions or locations for temperature control include a chamber wiper, a screen roller connected to the chamber wiper, or, if necessary, a metering roller connected to the screen roller or to a comparable applicator roller. It also is advantageous if the form cylinder transferring the coating layer or the coating medium is a device susceptible temperature control. In one suitable form of the invention, a heat exchanger is provided within each roller or chamber wiper. In another form of the invention, the temperature is detected at each element transmitting the coating medium.

In carrying out the invention, it is advantageous if the temperature control of the coating composition is no longer performed in a storage container, but instead directly at the place of processing. Suitable positions for temperature control are a chamber wiper, a screen roller connected to the chamber wiper, or, if necessary, a metering roller connected to the screen roller or to a comparable applicator roller. It is also advantageous if the form cylinder transferring the coating layer or the coating medium is realized as a device for temperature control. In a suitable form, there can be a heat exchanger within each roller or chamber wiper. In an additional suitable form, the temperature is detected at each element transmitting the coating medium.

Other objects and advantages of the invention will become apparent upon reading the following detailed description and upon reference to the drawings, in which:

Figure 1:
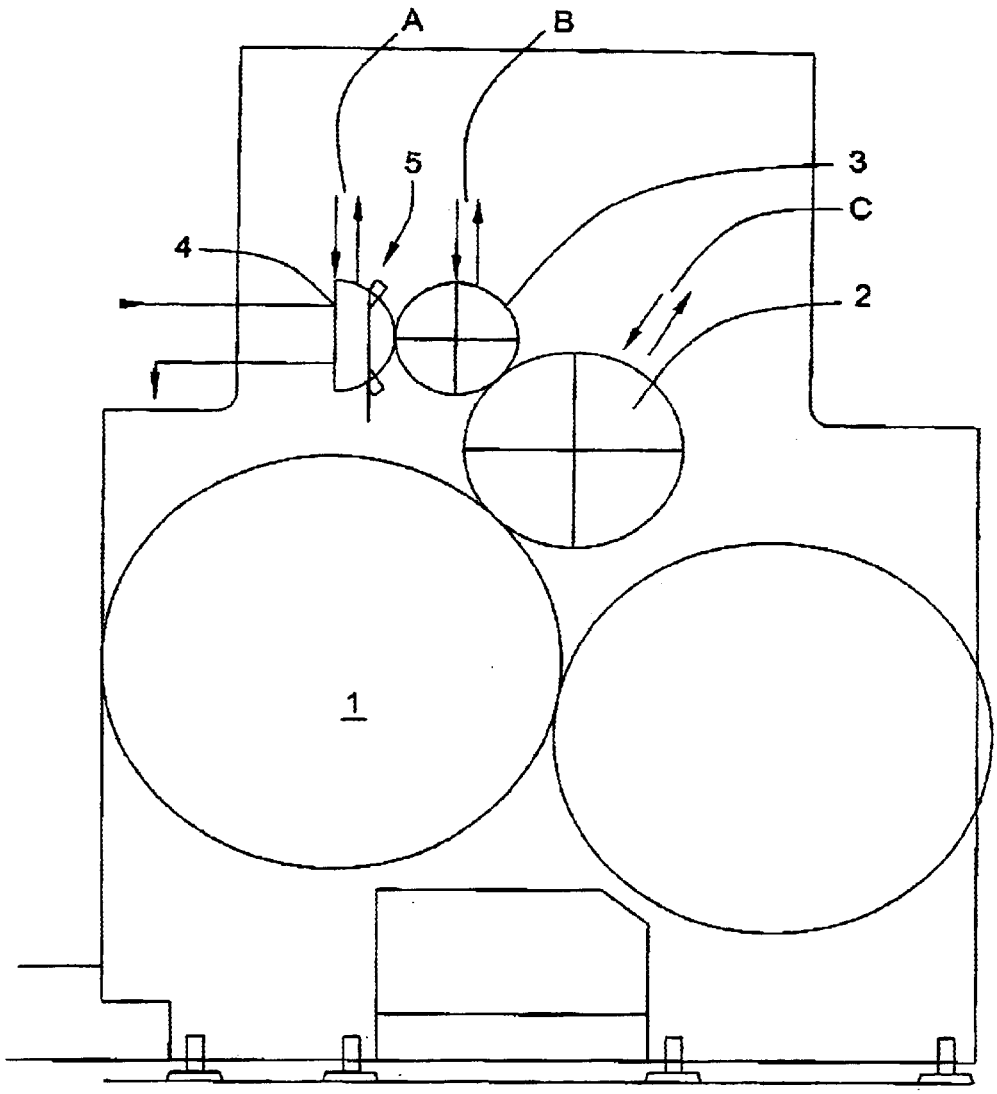
FIG. 1 is side elevational view of a printing machine having an applicator system with a temperature control in accordance with the invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to In re Appln. of Scholzig et al. cover all modifications, alternative constructions, and equivalents falling within the spirit and scope of the invention.

Referring now more particularly to the drawings, there is shown an illustrative printing machine having a coating medium applicator system in accordance with the invention. The applicator system includes a printing cylinder 1 for guiding a sheet to be coated, a form cylinder 2 for transferring a layer of the coating medium to the sheet to be printed, and a metering system 5 for generating the coating. In this case, the metering system 5 comprises an applicator roller in the form of a screen roller 3 having uniformly arranged cups about the periphery for transport of the coating medium. A chamber wiper 4 associated with the screen roller has two wipers, which together with the body of the chamber wiper, define a space for feeding the coating medium. The chamber wiper 4 is set with its two wipers against the screen roller 3 and transfers the coating medium into the recesses of the screen roller 3, with the coating medium being supplied to the chamber wiper by means of a pump. The coating medium is released when the screen roller 3 rolls onto the surface of the form cylinder 2, which has a printing form attached thereto. The printing form can a uniform surface that coats the entire printing area of a printing sheet, or it can be adopted for coating only parts of the printing sheet.

In accordance with an important aspect of the invention, the coating system is provided with temperature control devices for ensuring uniform processing of a wide possible range of coating media. To this end, in the illustrated embodiment, a heat enlarger A is mounted in the region of the chamber wiper 4. The heat-exchanger device A, which can be of a known type preferably is inserted into or attached to the wiper body. This allows the wiper body, including the wipers connected to the body, to be maintained at a predetermined temperature which, in turn, heats the coating medium in the chamber wiper 4 to a predetermined temperature. Thus, the coating medium may be continuously maintained at the preselected temperature. For this purpose, a temperature sensor can be provided in the chamber wiper 4 that continuously detects the temperature of the chamber wiper 4. Furthermore, a temperature sensor can be provided in the chamber wiper 4 that continuously detects the temperature of the coating medium. An arrangement with two sensors can provide permanent equalization. A controller guarantees that, if necessary, there is a sufficiently large temperature difference between the wiper body and the supplied coating medium so that for the processing the coating medium has the desired temperature adjusted for viscosity and transfer properties, as well as, if necessary, for drying properties.

Furthermore, the screen roller 3 can have a temperature-control device B known for inking systems of rotary printing presses. For this purpose, a series of flow channels that carry a temperature-controlled fluid in two directions can be formed in the screen roller 3. The flow channels are arranged such that the temperature-controlled fluid flows in one channel towards the screen roller 3 and in an adjacent channel, the fluid flows back in the opposite direction. In this way, the temperature-control fluid can be input and then removed from one side of the screen roller 3.

Another possible temperature-control method consists in providing the form cylinder 2 with a temperature-control device C like those known for screen rollers. For this purpose, there are also flow channels in the form cylinder 2 that can carry a temperature-controlled fluid.

Alternatively, for coating by means of a chamber wiper and a screen roller, there can also be a roller coating system. This roller coating system comprises, e.g., two rollers, of which one is the applicator roller corresponding to screen roller 3, and the second is a metering roller at the position of the chamber wiper 4. The coating medium is fed into a gap between the two rollers. By arranging temperature-control devices at both rollers, or, if necessary, only at one of the two rollers, the temperature of the coating medium to be transferred can be set precisely.

With the temperature-control devices described here, a so-called external temperature-control of the coating medium in the transport system of the coating medium can be eliminated. The coating supply devices can be of a conventional type. Obviously, it is also possible to combine the provided arrangement of temperature-control devices with external temperature-control devices. Furthermore, cleaning fluids that are to be applied to the surfaces contacting the coating medium can be preferably heated.

The temperature control can also be performed from the outside by means of radiators or by the supply of a gaseous temperature-control medium. Then the temperature control can be connected in a particularly effective way to the already metered thin films of the coating medium.

A particular advantage of the temperature control of chamber wiper 4 is that the wiper blade cannot be deformed by fluctuating temperatures. Deformation or bowing of the wiper leads to different meterings over the width of the wiper, which are hereby avoided.

The mentioned device enables processing combinations for applying different application processes of coating technology in sheet-fed offset printing presses or pure coating machines with several applicator systems. In this way, a dispersion coating can be coated on a dispersion coating. The dispersion coating can be combined with gold varnish. A dispersion coating as the bottom layer can be combined with a UV coating.

With the temperature-control devices described hererin, external temperature-control of the coating medium in the transport system of the coating medium can be eliminated. The coating supply devices can be of a conventional type. Obviously, it also is possible to combine the arrangement of temperature-control devices as described herein with external temperature-control devices. Furthermore, cleaning fluids that are to be applied to the surfaces contacting the coating medium can be preferably heated.

The temperature control also can be performed from the outside by means of radiators or by the supply of a gaseous temperature-control medium. Then the temperature control can be connected in a particularly effective way to the already metered thin films of the coating medium.

A particular advantage of the temperature control of chamber wiper 4 is that the wiper blades cannot be deformed by fluctuating temperatures. Deformation or bowing of the wiper leads to different meterings over the width of the wiper, which are hereby avoided.

The mentioned device enables processing combinations for applying different coating applications in sheet-fed offset printing presses or pure coating machines with several applicator systems. In this way, a dispersion coating can be coated on a dispersion coating. The dispersion coating can be combined with gold varnish. A dispersion coating as the bottom layer can be combined with a UV coating. Finally, two layers of UV coating can be applied. In the case of dispersion coating, the temperature control is used to stabilize the coating properties. In the case of UV coating, the temperature control, particularly through heating, is used to improve the processing properties, e.g., of the distribution of the coating on a surface. Cooling can be performed, e.g., for an aqueous metal pigment coating or a metal pigment printing ink, because this coating or this printing ink exhibits an optimum consistency within certain temperature ranges.

The described system can be expanded by also providing roller coating systems or roller lining units with an optional, temperature-controllable coating tank that is comparable to the chamber wiper 4 or the coating supply to a so-called crushing roller system, e.g., a coating knife that dips into a coating storage tank between the two rollers forming the crushing roller, system.

What is claimed is:

1. A coating system for supplying a coating medium to sheet material during sheet transfer comprising a coating medium applicator system including a form cylinder (2) for applying coating medium to sheet material and a metering system (5) for metering and transferring a predetermined amount of coating medium to said form cylinder (2) or sheet material attached to the form cylinder (2); said metering system including a wiper chamber (4) having a wiper body and at least one wiper blade for containing a quantity of coating material, a screen roller (3) in contacting interposed relation between said wiper chamber (4) and said form cylinder (2) for receiving a metered quantity of coating medium from said wiper chamber (4) and transferring said coating medium directly to said form cylinder (2) or sheet material attached to the form cylinder (2), a sensing device for detecting the temperature of said coating medium; at least one of said wiper chamber (4) and screen roller (3) which contact the coating medium during transport to the sheet material having an associated heat exchanger (A; B) such that the temperature of the coating medium can be influenced during metering or transport immediately prior to application onto the sheet material.

2. The coating system of claim 1 in which said heat exchanger is operable for supplying heat to at least one of said wiper chamber and screen roller.

3. The coating system of claim 1 in which said heat exchanger is operable for dissipating heat from at least one of said wiper chamber and screen roller.

4. The coating system of claim 1 including a heat exchanger is operable for supplying heat to said form cylinder.

5. The coating system of claim 1 including a heat exchanger operable for dissipating heat from said form cylinder.

6. The coating system of claim 1 in which said heat exchanger is located within at least one of said wiper chamber and screen roller.

7. The coating system of claim 1 in which said screen roller is formed with flow channels through the coating medium passes, and said heat exchanger is operable for controlling the temperature of the medium passing through the low channels.

8. The coating system of claim 1 in which said heat exchanger is located on an exterior side of said wiper chamber and screen roller.

9. The coating system of claim 8 in which said heat exchanger is in the form of a radiator.

10. The coating system of claim 8 in which said heat exchanger is a temperature-controlled air directing means.

11. The coating system of claim 1 in which each of said wiper chamber and screen roller have at least one sensor for detecting the temperature of the coating medium at each location.

12. The coating system of claim 1 in which each of said wiper chamber and screen roller have at least one sensor for detecting the temperature of each of the wiper chamber and screen roller.

13. The coating system of claim 1 in which said wiper chamber (4) has two wipers in contacting relation to said screen roller (3).

* * * * *